US011026511B1

(12) United States Patent
Moreno

(10) Patent No.: US 11,026,511 B1
(45) Date of Patent: Jun. 8, 2021

(54) FURNITURE LEG CAP ASSEMBLY

(71) Applicant: Fernando Moreno, Tacoma, WA (US)

(72) Inventor: Fernando Moreno, Tacoma, WA (US)

( * ) Notice: Subject to any disclaimer, the term of this patent is extended or adjusted under 35 U.S.C. 154(b) by 0 days.

(21) Appl. No.: 16/735,093

(22) Filed: Jan. 6, 2020

(51) Int. Cl.
*A47B 91/00* (2006.01)
*A47B 91/12* (2006.01)

(52) U.S. Cl.
CPC ..... *A47B 91/12* (2013.01)

(58) Field of Classification Search
CPC .... F16M 2200/08; F16M 11/36; A47B 91/00; A47B 91/04; A47B 97/12
See application file for complete search history.

(56) References Cited

U.S. PATENT DOCUMENTS 763,306 A 6/1904 Miller
2,020,230 A * 11/1935 Beisel ..... A47C 3/02 248/501
3,357,669 A * 12/1967 Amato ..... A47B 91/12 248/346.11
3,456,757 A * 7/1969 Sain ..... E06C 7/46 182/111
3,596,945 A * 8/1971 Mulvin ..... A47B 3/0818 403/84
4,076,202 A * 2/1978 McConnell ..... A47B 91/12 248/188.2
4,415,062 A * 11/1983 Shaw ..... E06C 7/46 182/109
5,868,372 A 2/1999 Novak
6,761,340 B2 7/2004 Shaw
7,124,986 B1 10/2006 Bailey
8,407,855 B2 4/2013 Gagnon
D811,027 S 2/2018 Wright
D831,228 S * 10/2018 Lanzafame ..... E06C 7/426 D25/68
2004/0094496 A1* 5/2004 MacDonald ..... A47B 91/00 211/189
2008/0134620 A1* 6/2008 Contasti ..... F16B 15/0053 52/712
2012/0061545 A1 3/2012 Schneider

* cited by examiner

*Primary Examiner* — Steven M Marsh

(57) ABSTRACT

A furniture leg cap assembly for protecting furniture legs from damage includes a plate that has a plurality of fold lines integrated therein to define a plurality of wings each extending away from a central portion of the plate. The central portion is positionable against a bottom end of a furniture leg and each of the wings is folded along the fold lines such that each of the wings extends upwardly along respective sides of the furniture leg. Moreover, the plate is comprised of a resilient material to inhibit deterioration of the furniture leg resulting from sliding on a surface. Each of the wings has fasteners extended therethrough for attaching the plate to the furniture leg.

6 Claims, 5 Drawing Sheets

FURNITURE LEG CAP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to leg cap devices and more particularly pertains to a new leg cap device for protecting furniture legs from damage.

(2) Description of Related Art Including Information Disclosed Under 37 CFR 1.97 and 1.98

The prior art relates to leg cap devices. The prior art discloses a variety of furniture leg caps, each being formed into a pre-determined, cup-like shape, for positioning on a furniture leg. Additionally, the prior art discloses a base that is attachable to legs of lawn furniture to inhibit the legs from sinking into ground. In no instance does the prior art disclose foldable elements with respect to the furniture leg caps.

BRIEF SUMMARY OF THE INVENTION

An embodiment of the disclosure meets the needs presented above by generally comprising a plate that has a plurality of fold lines integrated therein to define a plurality of wings each extending away from a central portion of the plate. The central portion is positionable against a bottom end of a furniture leg and each of the wings is folded along the fold lines such that each of the wings extends upwardly along respective sides of the furniture leg. Moreover, the plate is comprised of a resilient material to inhibit deterioration of the furniture leg resulting from sliding on a surface. Each of the wings has fasteners extended therethrough for attaching the plate to the furniture leg.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
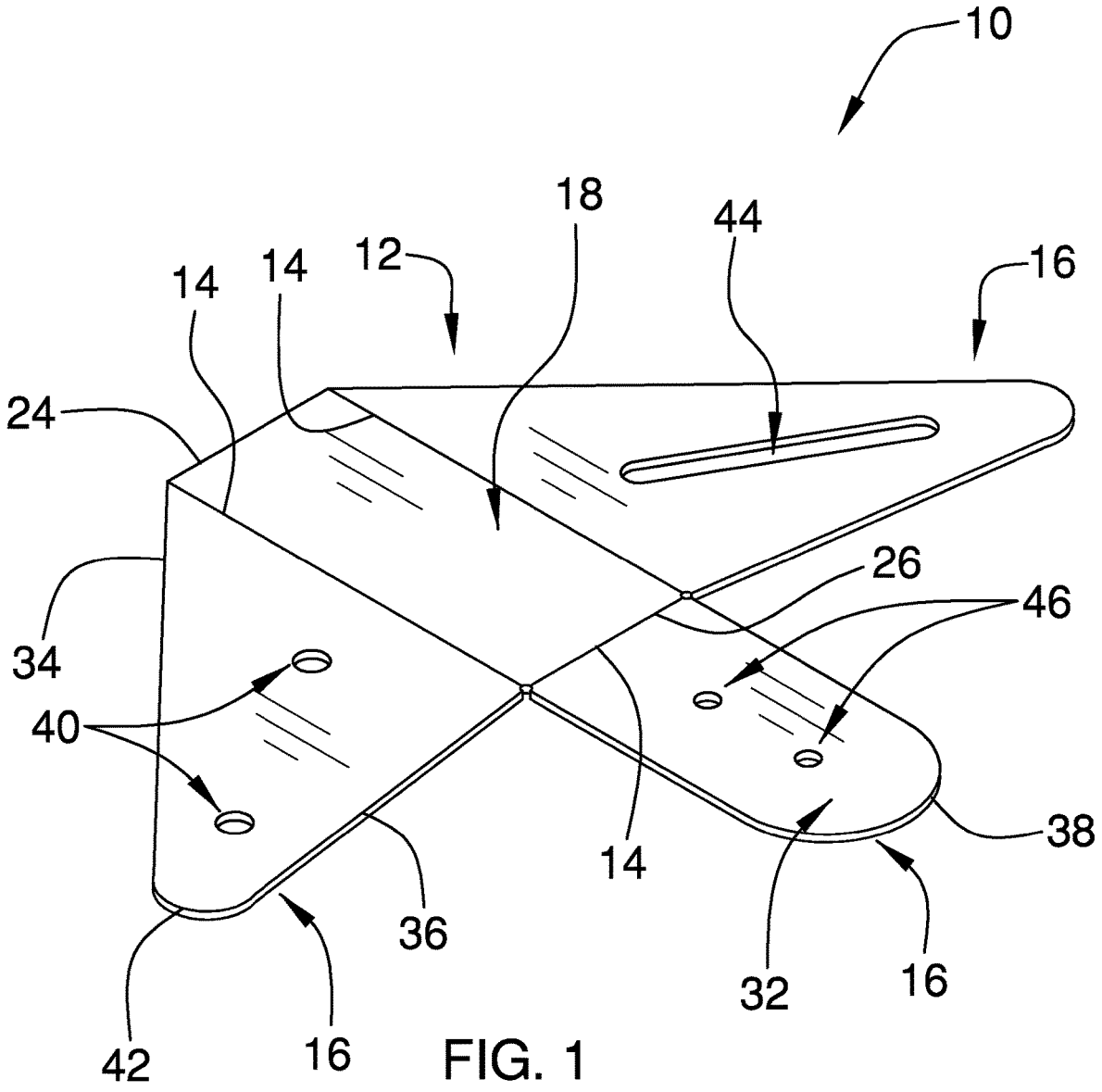
FIG. 1 is a top perspective view of a furniture leg cap assembly according to an embodiment of the disclosure.
Figure 2:
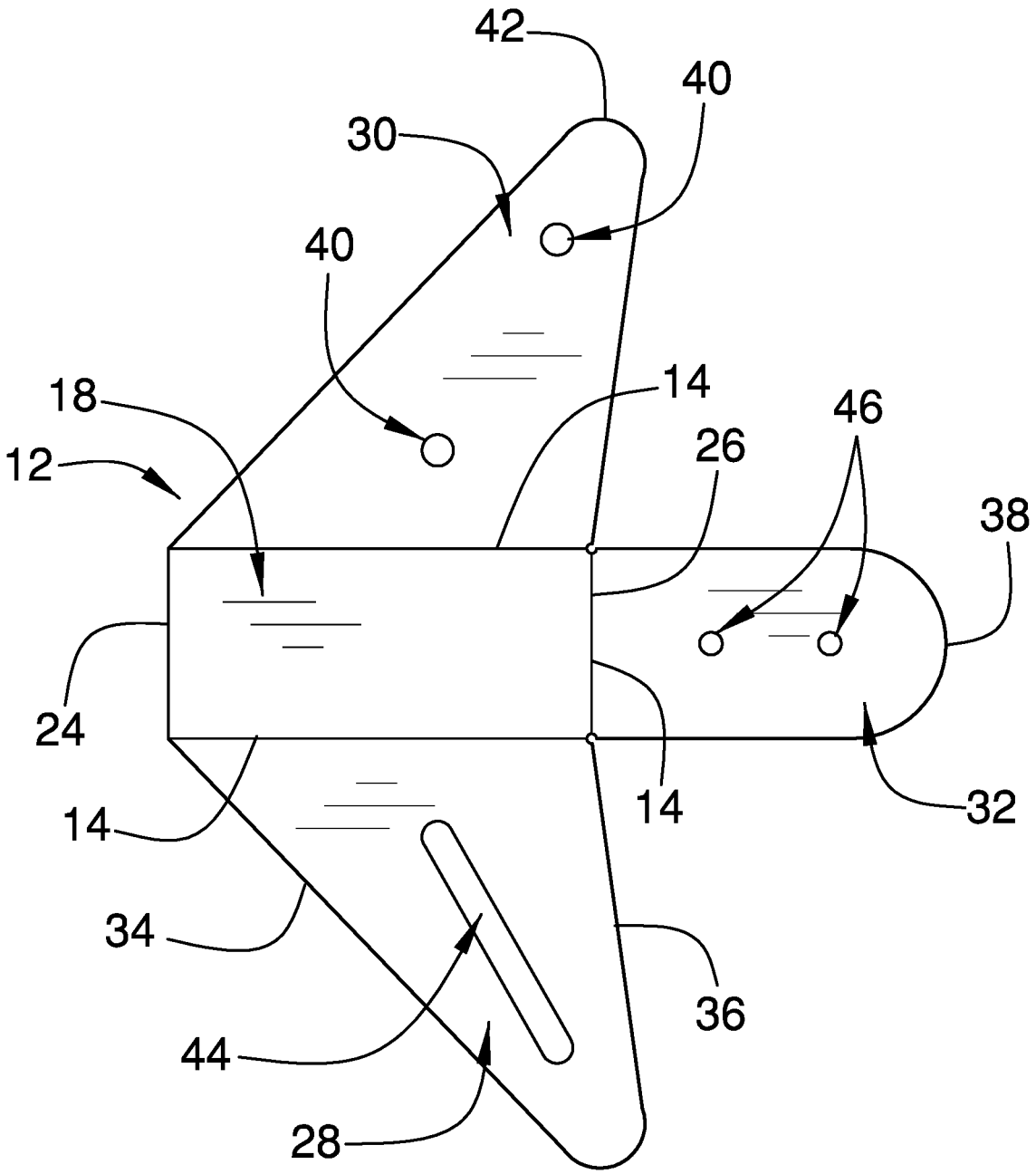
FIG. 2 is a bottom view of an embodiment of the disclosure.
Figure 3:
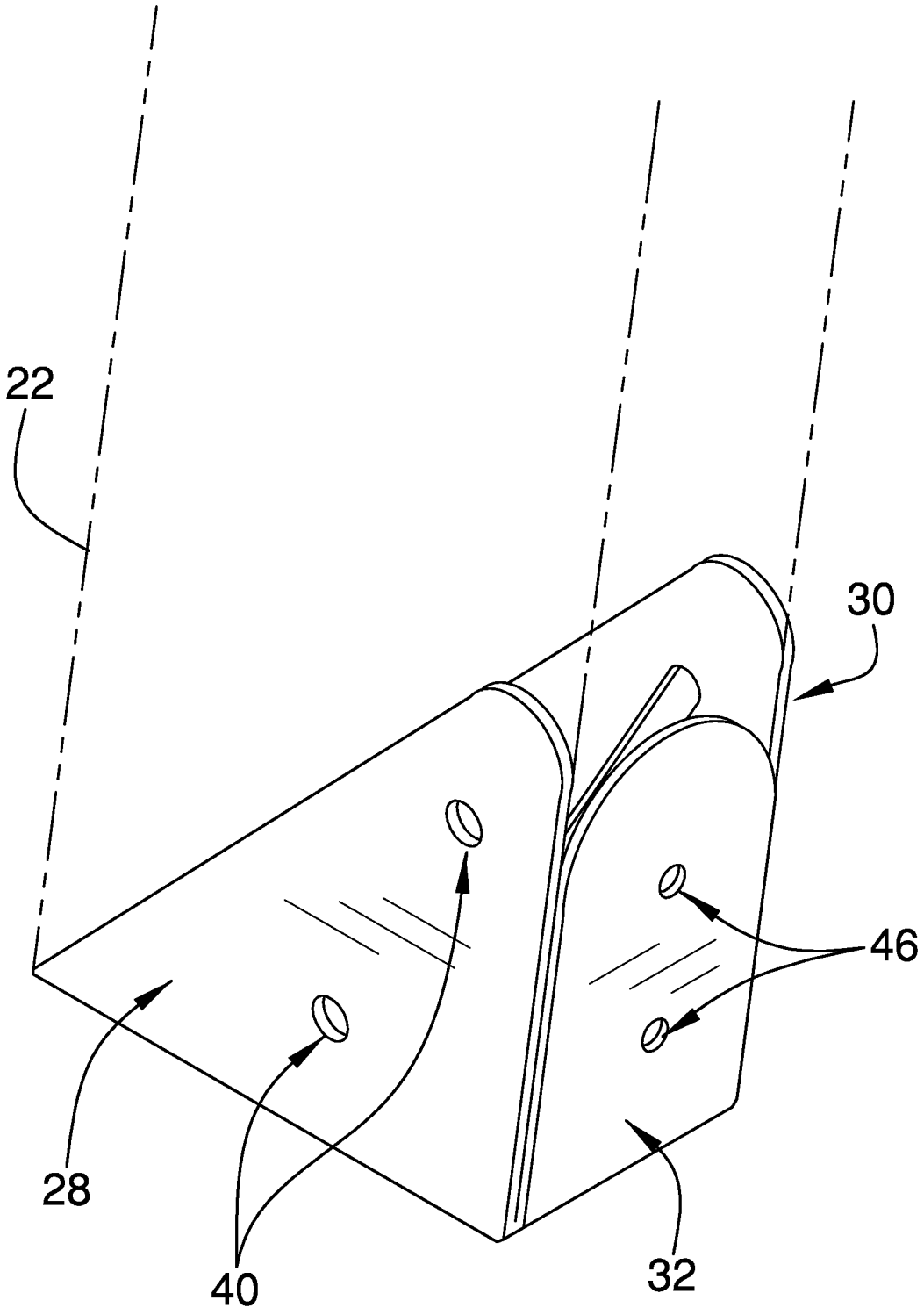
FIG. 3 is a perspective in-use view of an embodiment of the disclosure.
Figure 4:
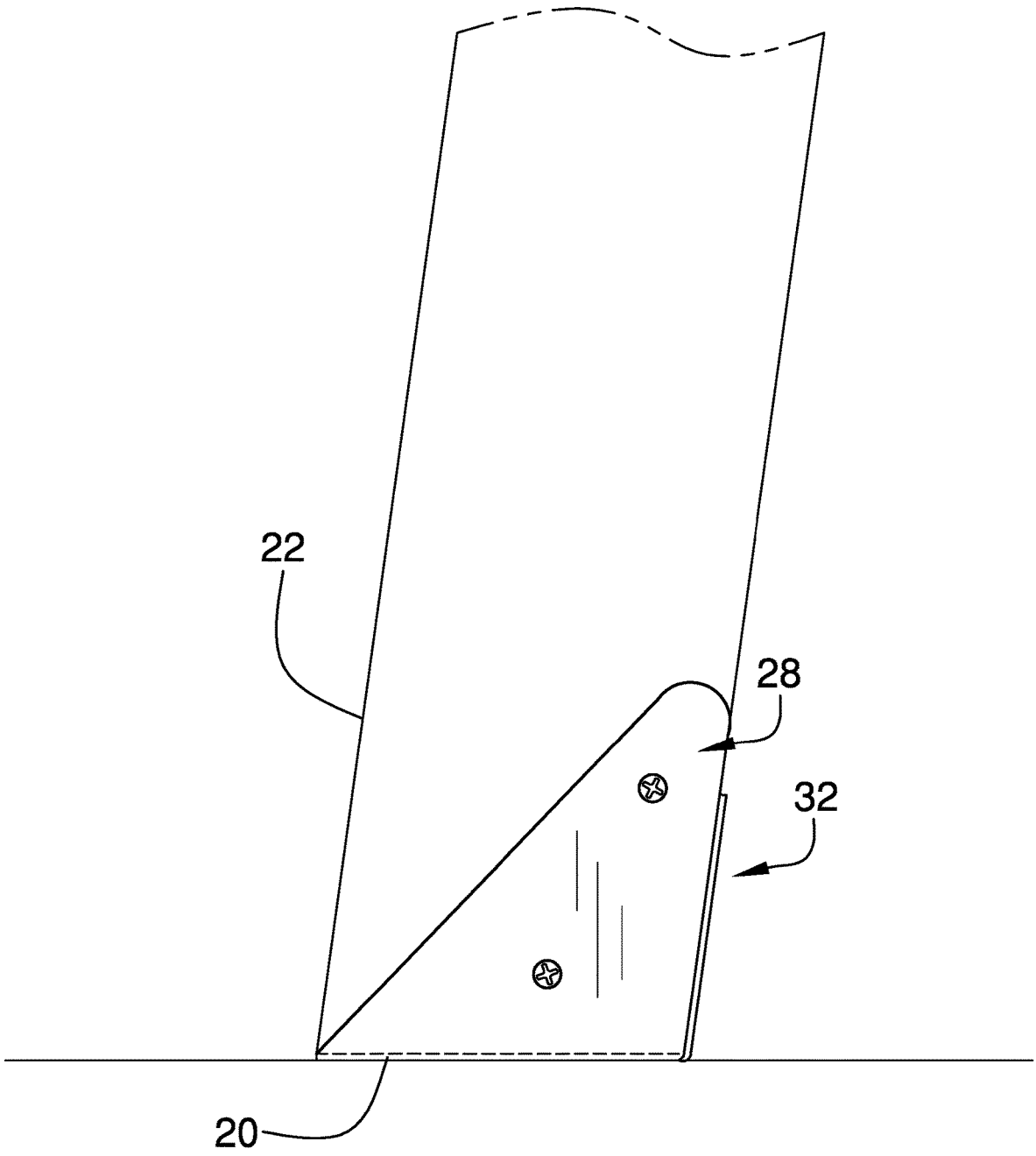
FIG. 4 is a left side in-use view of an embodiment of the disclosure.
Figure 5:
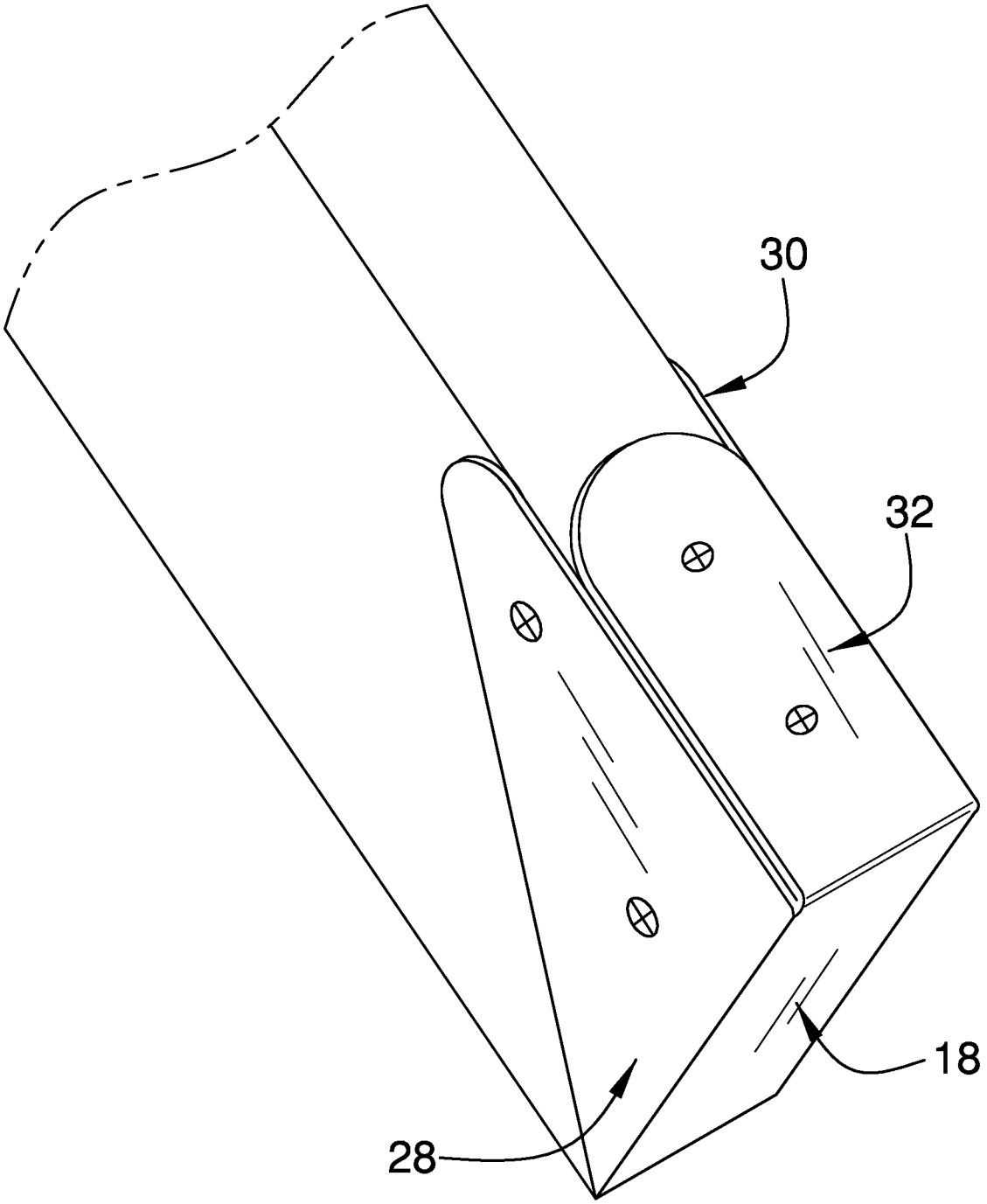
FIG. 5 is a back perspective in-use view of an embodiment of the disclosure.

With reference now to the drawings, and in particular to FIGS. 1 through 5 thereof, a new leg cap device embodying the principles and concepts of an embodiment of the disclosure and generally designated by the reference numeral 10 will be described.

As best illustrated in FIGS. 1 through 5, the furniture leg cap assembly 10 generally comprises a plate 12 that has a plurality of fold lines 14 integrated therein to define a plurality of wings 16 each extending away from a central portion 18 of the plate 12. The central portion 18 is positionable against a bottom end 20 of a furniture leg 22, such as the leg of a chair or the like. Each of the wings 16 is folded along the fold lines 14 such that each of the wings 16 extends upwardly along respective sides of the furniture leg 22. Additionally, the plate 12 is comprised of a resilient material to inhibit deterioration of the furniture leg 22 resulting from sliding on a surface.

Each of the fold lines 14 is oriented to define respective sides of a rectangular shape defining the central portion 18. The central portion 18 has a forward end 24 and a back end 26, and the central portion 18 is elongated between the forward end 24 and the back end 26. The plurality of wings 16 includes a first wing 28, a second wing 30 and a rear wing 32. Each of the first wing 28 and the second wing 30 extend laterally away from the central portion 18 in opposite directions from each other. Additionally, the rear wing 32 extends rearwardly from the back end 26 of the central portion 18.

Each of the first wing 28 and the second wing 30 has a forward edge 34 and a rearward edge 36. The forward edge 34 intersects the forward end 24 of the central portion 18 and the rearward edge 36 intersects the back end 26 of the central portion 18. The forward edge 34 angles rearwardly toward the rearward edge 36 such that each of the first wing 28 and the second wing 30 has a triangular shape. The rearward edge 36 angles rearwardly from the back end 26 of the central portion 18.

The rear wing 32 has a distal end 38 with respect to the back end 26 of the central portion 18 and the distal end 38 is rounded. The first wing 28 has a pair of first apertures 40 extending therethrough, and the first apertures 40 are spaced apart from each other and are distributed between the central portion 18 and an end 42 of the first wing 28. The second wing 30 has a slot 44 extending therethrough, and the slot 44 is elongated to extend substantially between the central portion 18 and an end 45 of the second wing 30.

The rear wing 32 has a pair of second apertures 46 extending therethrough. The second apertures 46 are spaced apart from each other and are distributed between the back end 26 of the central portion 18 and the distal end 38 of the rear wing 32. Each of the first apertures 40, the slot 44 and the second apertures 46 insertably receives a fastener that engages the furniture leg 22 for retaining the plate 12 on the furniture leg 22. The fastener may be a screw, a nail or other appropriate fastener.

In use, the central portion 18 of the plate 12 is positioned against the bottom end 20 of the furniture leg 22. Each of the first wing 28, the second wing 30 and a rear wing 32 are folded upwardly, along the respective fold lines 14, to extend upwardly along the furniture leg 22. The fasteners are extended through the first apertures 40, the second apertures 46 and the slot 44 for attaching the plate 12 to the furniture leg 22. In this way the plate 12 inhibits deterioration of the furniture leg 22, thereby enhancing the service life of the furniture leg 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A furniture leg cap assembly being configured to be attached to the bottom of a furniture leg for inhibiting deterioration of the furniture leg, said assembly comprising:

a plate having a plurality of fold lines being integrated therein to define a plurality of wings each extending away from a central portion of said plate, said central portion being positionable against a bottom end of a furniture leg, each of said wings being folded along said fold lines such that each of said wings extends upwardly along respective sides of the furniture leg, said plate being comprised of a resilient material wherein said plate is configured to inhibit deterioration of the furniture leg resulting from sliding on a surface, each of said wings having fasteners extended therethrough for attaching said plate to the furniture leg, said plurality of wings including a first wing, a second wing and a rear wing, each of said first wing and said second wing extending laterally away from said central portion in opposite directions from each other, said first wing having a pair of first apertures extending therethrough, said first apertures being spaced apart from each other and being distributed between said central portion and an end of said first wing, said second wing having a slot extending therethrough, said slot being elongated to extend substantially between said central portion and an end of said second wing distal to the central portion.

2. The assembly according to claim 1, wherein each of said fold lines is oriented to define respective sides of a rectangular shape defining said central portion, said central portion having a forward end and a back end, said central portion being elongated between said forward end and said back end said rear wing extending rearwardly from said back end of said central portion.

3. The assembly according to claim 2, wherein each of said first wing and said second wing has a forward edge and a rearward edge, said forward edge intersecting said forward end of said central portion, said rearward edge intersecting said back end of said central portion, said forward edge angling rearwardly toward said rearward edge such that each of said first wing and said second wing has a triangular shape, said rearward edge angling rearwardly from said back end of said central portion.

4. The assembly according to claim 3, wherein said rear wing has a distal end with respect to said back end of said central portion, said distal end being rounded.

5. The assembly according to claim 1, wherein said rear wing has a pair of second apertures extending therethrough, said second apertures being spaced apart from each other and being distributed between said rear end of said central portion and said distal end of said rear wing.

6. A furniture leg cap assembly being configured to be attached to the bottom of a furniture leg for inhibiting deterioration of the furniture leg, said assembly comprising:

a plate having a plurality of fold lines being integrated therein to define a plurality of wings each extending away from a central portion of said plate, said central portion being positionable against a bottom end of a furniture leg, each of said wings being folded along said fold lines such that each of said wings extends upwardly along respective sides of the furniture leg, said plate being comprised of a resilient material wherein said plate is configured to inhibit deterioration of the furniture leg resulting from sliding on a surface, each of said fold lines being oriented to define respective sides of a rectangular shape defining said central portion, said central portion having a forward end and a back end, said central portion being elongated between said forward end and said back end, said plurality of wings including a first wing, a second wing and a rear wing, each of said first wing and said second wing extending laterally away from said central portion in opposite directions from each other, said rear wing extending rearwardly from said back end of said central portion, each of said first wing and said second wing having a forward edge and a rearward edge, said forward edge intersecting said forward end of said central portion, said rearward edge intersecting said back end of said central portion, said forward edge angling rearwardly toward said rearward edge such that each of said first wing and said second wing has a triangular shape, said rearward edge angling rearwardly from said back end of said central portion, said rear wing having a distal end with respect to said back end of said central portion, said distal end being rounded, said first wing having a pair of first apertures extending therethrough, said first apertures being spaced apart from each other and being distributed between said central portion and an end of said first wing, said second wing having a slot extending therethrough, said slot being elongated to extend substantially between said central portion and an end of said second wing distal to the central portion, said rear wing having a pair of second apertures extending therethrough, said second apertures being spaced apart from each other and being distributed between said rear end of said central portion and said distal end of said rear wing, each of said first apertures, said slot and said second aperture insertably receiving a fastener that engages the furniture leg for retaining said plate on the furniture leg.

* * * * *